US008740662B2

(12) United States Patent
Gallato et al.

(10) Patent No.: US 8,740,662 B2
(45) Date of Patent: Jun. 3, 2014

(54) SEALING ARRANGEMENT FOR A PIVOTABLE BOAT DRIVE

(75) Inventors: Fernando Gallato, Padua (IT); Adone Bertolo, Padua (IT); Andrea Tognon, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 446 days.

(21) Appl. No.: 13/145,608

(22) PCT Filed: Feb. 11, 2010

(86) PCT No.: PCT/EP2010/051697

§ 371 (c)(1),
(2), (4) Date: Jul. 21, 2011

(87) PCT Pub. No.: WO2010/094611

PCT Pub. Date: Aug. 26, 2010

(65) Prior Publication Data

US 2011/0291367 A1 Dec. 1, 2011

(30) Foreign Application Priority Data

Feb. 18, 2009 (DE) ..... 10 2009 000 994

(51) Int. Cl.
*B63H 23/36* (2006.01)

(52) U.S. Cl.
USPC ..... 440/112

(58) Field of Classification Search
USPC ..... 440/112
IPC ..... B63H 20/02
See application file for complete search history.

(56) References Cited

U.S. PATENT DOCUMENTS

| | | | | |
|---|---|---|---|---|
| 3,982,496 | A | 9/1976 | Blanchrd | |
| 4,040,378 | A * | 8/1977 | Blanchard | 440/52 |
| 4,478,585 | A | 10/1984 | Brandt et al. | |
| 4,543,069 | A * | 9/1985 | Kobayashi | 440/112 |
| 5,643,026 | A | 7/1997 | Pietsch et al. | |
| 6,478,646 | B1 | 11/2002 | Fukuoka et al. | |
| 6,481,720 | B1 * | 11/2002 | Yoshida et al. | 277/400 |
| 7,186,157 | B2 | 3/2007 | Mansson et al. | |
| 7,387,556 | B1 | 6/2008 | Davis | |

FOREIGN PATENT DOCUMENTS

| | | |
|---|---|---|
| DE | 81 11 209 U1 | 11/1982 |
| DE | 31 22 406 A1 | 12/1982 |
| DE | 33 03 658 A1 | 8/1983 |
| DE | 42 28 005 A1 | 4/1993 |

(Continued)

OTHER PUBLICATIONS

Chinese Office Action issued in corresponding Chinese Patent Application No. 201080007620.8 mailed Jul. 1, 2013.

(Continued)

*Primary Examiner* — Stephen Avila
(74) *Attorney, Agent, or Firm* — Davis & Bujold, PLLC; Michael J. Bujold

(57) ABSTRACT

A sealing arrangement (1) for a pivotally arranged boat drive in a hull of a boat, the boat drive extends through a hull opening in the bottom of the boat. The boat drive forms, together with the hull of the boat or with a connecting piece (2) set into the hull of the boat, an annular gap. The annular gap is bridged by at least two flexible sealing elements (5, 6), and the at least two sealing elements (5, 6) enclose at least one ring chamber (7) between them.

12 Claims, 2 Drawing Sheets

(56) References Cited

FOREIGN PATENT DOCUMENTS

| | | | |
|---|---|---|---|
| DE | 44 34 247 | A1 | 3/1996 |
| GB | 1 569 661 | | 6/1980 |
| JP | H11291987 | A | 10/1999 |
| JP | 2008-001208 | A | 1/2008 |
| WO | 9935034 | A1 | 7/1999 |
| WO | 03093105 | A1 | 11/2003 |
| WO | 2005/005249 | A1 | 1/2005 |

OTHER PUBLICATIONS

Japanese Office Action issued in corresponding Japanese Patent Application No. 2011-550523 mailed on Feb. 12, 2014.

* cited by examiner

SEALING ARRANGEMENT FOR A PIVOTABLE BOAT DRIVE

This application is a National Stage completion of PCT/EP2010/051697 filed Feb. 11, 2010, which claims priority from German patent application serial no. 10 2009 000 994.9 filed Feb. 18, 2009.

FIELD OF THE INVENTION

The invention concerns a sealing arrangement for a pivotable boat drive.

BACKGROUND OF THE INVENTION

Known inboard boat drives comprise a steering and propulsion unit arranged underwater, which can be pivoted about a vertical axis. Propulsion is produced by one or two propellers whose rotational axis can be pivoted by the steering unit. Thanks to the ability of the propulsion vector to be pivoted, a steering action for the boat is achieved. The propulsion and steering unit comprises a vertically arranged column which accommodates the driveshaft for the propeller and which passes through a bottom plate set into the boat's hull, this also being known as the connecting piece. In known boat drives the pivotable steering and propulsion unit is supported and sealed relative to the hull opening by elastic rings, i.e. at the same time reaction forces resulting from the propeller thrust are transmitted directly into the hull. A disadvantage of the known sealing arrangement is that the elastic rings are subjected to relatively large forces and must therefore have relatively high elasticity, which is less advantageous for a good sealing action. However, such a seal is prone to increased wear due to relative movements between the seal and the component to be sealed.

From WO 2005/005249 A1 a similarly pivotable boat drive with a traction double propeller is known.

SUMMARY OF THE INVENTION

The purpose of the present invention is to provide a sealing arrangement of the type mentioned at the start, with an improved sealing action and continuous functional control of the sealing action, in particular during vertical movements of the boat drive caused by oscillations.

According to the invention the boat drive passes through the hull opening with an annular gap bridged by at least two flexible sealing elements, so that a closed ring chamber is formed around the periphery of the boat drive. The effect of this sealed ring chamber is that the boat drive can undergo relative movements in relation to the boat's hull, especially in the vertical direction. This is particularly advantageous for a boat drive suspended elastically relative to the boat's hull, and which therefore undergoes oscillations especially in the vertical direction.

In a preferred embodiment the ring chamber is filled with a control liquid and communicates with a control container. This gives the advantage of continuous control of the sealing action. Preferably, the control container has a liquid level indicator by means of which the liquid level can be checked continuously. For example, if the liquid level in the control container falls, control liquid is leaking out of the ring chamber, i.e. the inner sealing element (the one facing the inside of the boat) is not leak-proof so the control liquid is flowing out into the inside of the boat. On the other hand the level of the control liquid in the control container may rise, in which case seawater is making its way into the ring chamber, i.e. the outer sealing element on the seawater side is leaking, whereas the inner sealing element is still intact. Finally, it may be that both the inner and the outer sealing elements develop leaks, and then too there will be a change of the check level, tantamount to a warning of water penetration.

In a preferred embodiment the control container is arranged inside the boat and connected to the ring chamber by a flexible line. This enables the control container to be arranged in any desired position in the boat and the liquid level in the control container to be read conveniently.

According to a further preferred embodiment the at least two sealing elements are in the form of bellows or siphon-joint seals, preferably having bead-like thickened portions at their inner and outer circumferences. This has the advantage that the seals can be clamped firmly on both sides while on the other hand allowing relative movements in the vertical direction.

Further preferred embodiments comprise a first clamping device at the periphery of the boat drive and a second clamping device around the periphery of the hull opening. This enables the sealing elements with their peripheral beads to be clamped on both sides, producing a leak-proof seal. This also defines the volume of the ring chamber holding the control liquid.

In a further preferred embodiment the hull opening is formed in a hull connecting piece, also called just the connecting piece in what follows, which can be set into the boat's hull. This has the advantage that the ring chamber, the flexible sealing elements and the clamping devices with the connecting piece can be preassembled as a structural unit which is then set into the actual hull.

In a further preferred embodiment the hull connecting piece can be made as a crash component, preferably with a sandwich structure. Since owing to the flexible sealing elements the connecting piece does not sustain any reaction forces from the propeller thrust, it can be made light and deformable. As a crash component it serves to increase the safety of the boat's hull.

BRIEF DESCRIPTION OF THE DRAWINGS

An example embodiment of the invention is shown in the drawing and will be described in more detail below, so that further features and/or advantages may emerge from the description and/or the drawing, which shows.

DETAILED DESCRIPTION OF THE PREFERRED EMBODIMENTS

Figure 1A:
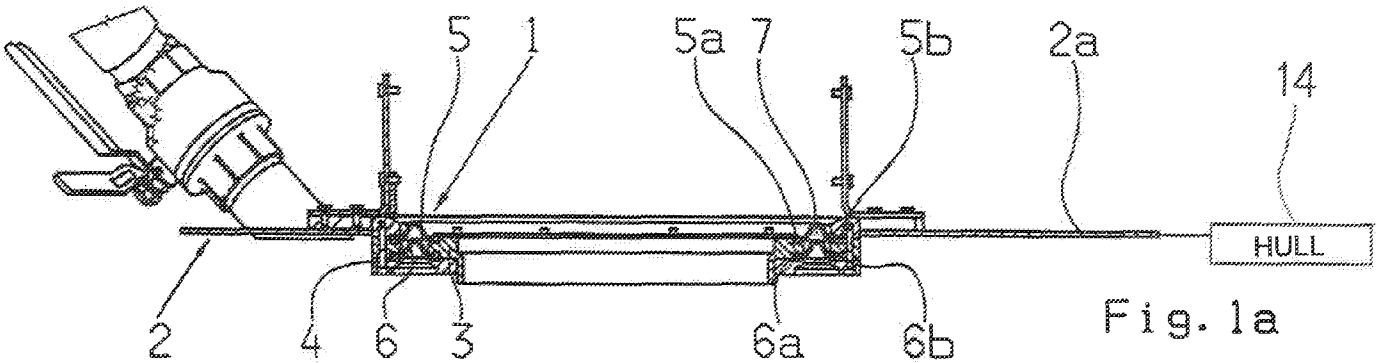
FIGS. 1*a*, 1*b*: A sealing arrangement according to the invention, fixed to a hull connecting piece.
Figure 1B:
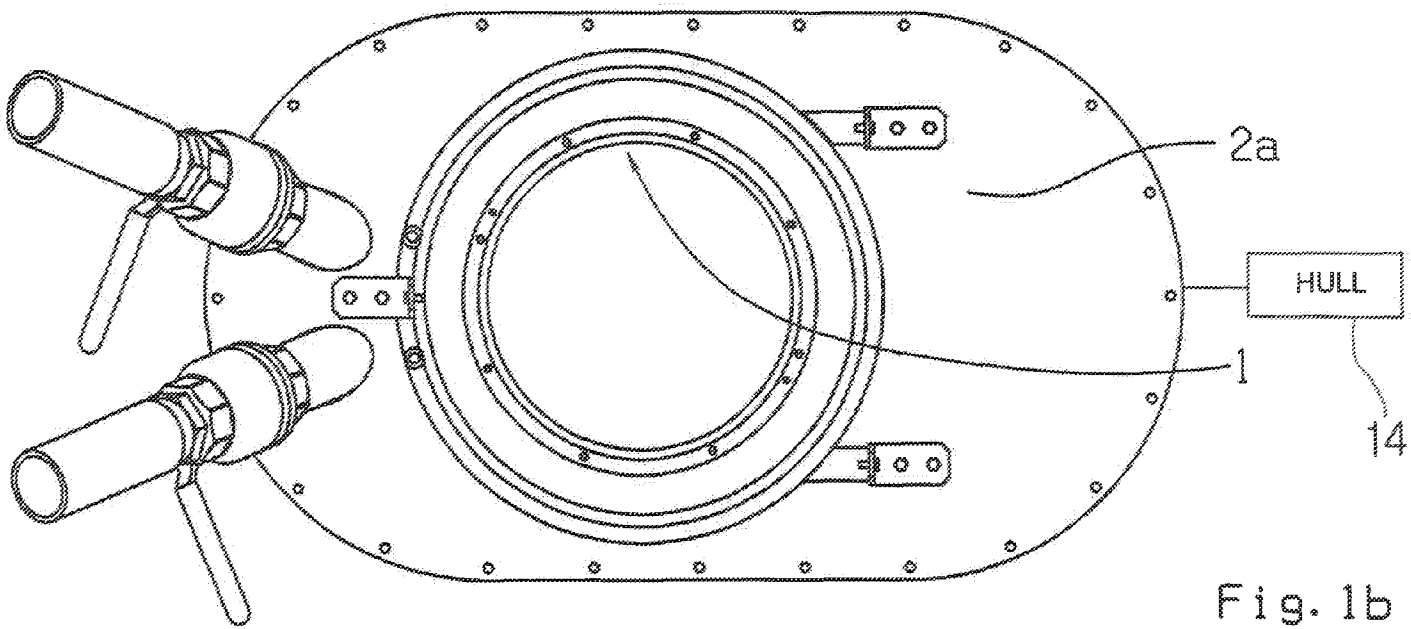

FIG. 1*a* shows a sealing arrangement 1 according to the invention, viewed in cross-section, while FIG. 1*b* shows the sealing arrangement 1 viewed from above, fitted into a hull connecting piece 2 also called the connecting piece 2 for short in what follows. The connecting piece 2 is set into an opening (not shown) corresponding to the oval periphery of the connecting piece 2 in a boat's hull 14 (shown only diagrammatically in FIGS. 1*a*, 1*b*), and is connected to it firmly and in a sealed manner. In a patent application by the present applicant (applicant's internal file number: 002087) filed at the same time, a connecting piece of this type with a sandwich structure is described in detail. The sealing arrangement 1 comprises a first (inner) clamping device 3, a second (outer) clamping device 4 and two flexible sealing elements in the form of bellows seals 5, 6, each having respective ring beads 5*a*, 5*b*, 6*a*, 6*b* along their inner and outer peripheries. The bellows seals 5, 6, which are clamped with their ring beads 5*a*, 5*b*, 6*a*, 6*b* in the clamping devices 3, 4, form a closed ring chamber 7. The second (outer) clamping device 4 is connected fast to the connecting piece 2 and forms with it a preassembled structural unit, which is set into the boat's hull (not shown). The connecting piece 2 is shown only incompletely, i.e. essentially only with an upper steel plate 2*a*. The sealing element 5 arranged at the top in the drawing faces toward the inside space of the boat's hull; the sealing element 6 arranged at the bottom in the drawing is arranged on the seawater side. As will be described below, the ring chamber 7 is filled with a control liquid which serves to enable checking of the sealing action of the two sealing elements 5, 6.

Figure 2:
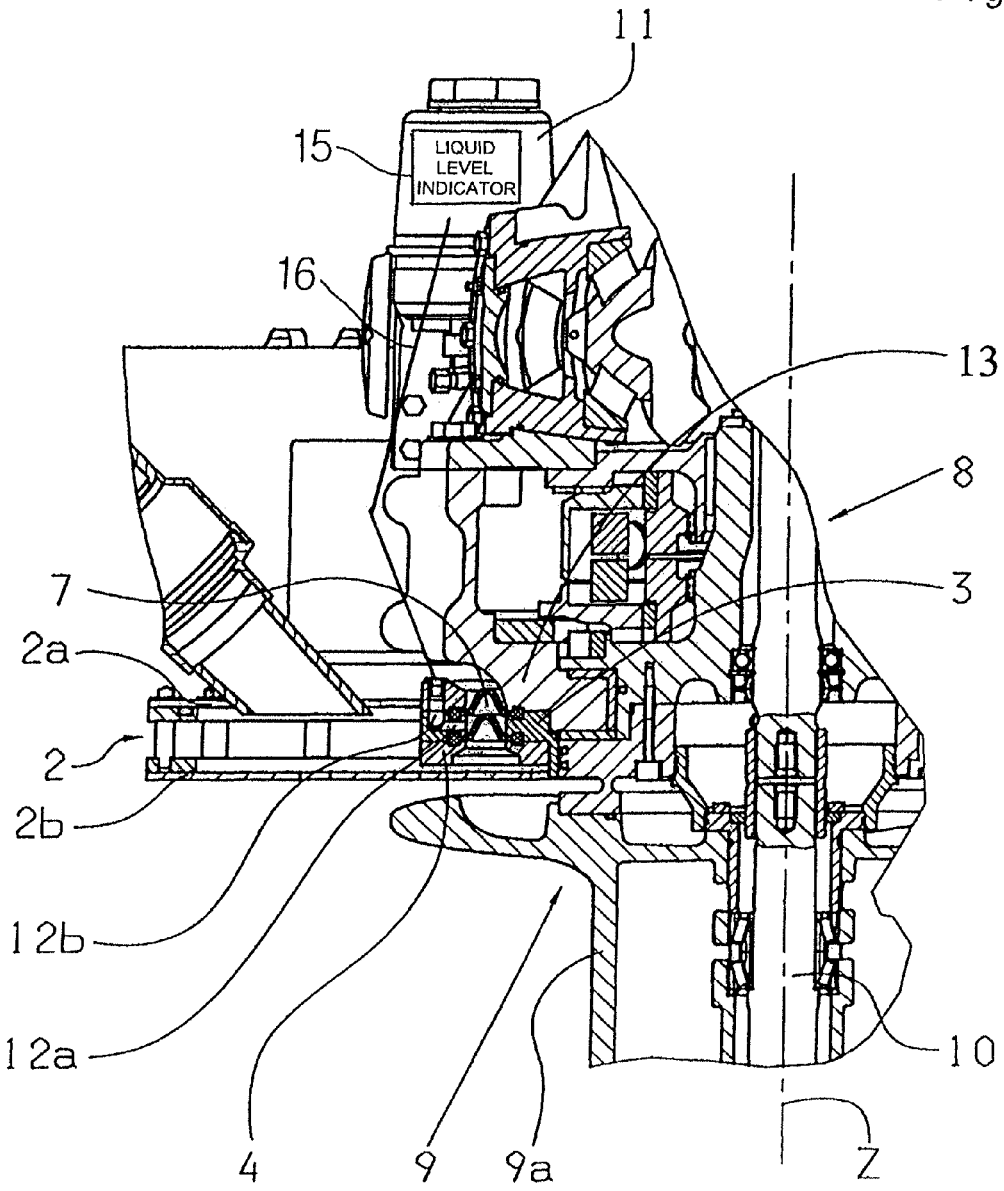
FIG. 2: A partial section through a boat drive in combination with the sealing arrangement shown in FIG. 1*a*.

FIG. 2 shows the sealing arrangement 1 in combination with a partially shown boat drive 8 and the connecting piece 2, shown here with the inner steel plate 2*a* and an outer (seawater side) steel plate 2*b*. The boat drive 8 comprises a pivotable steering device 9 that can be driven by a transmission (not explained further), with a housing 9*a* for accommodating a driveshaft 10 for a propeller (not shown), also called the screw. The steering device 9 is mounted to pivot about the vertical axis z relative to a mount 13 supported on the hull, and is fixed in both axial directions. The inner clamping device 3 is fixed onto the mount 13 while the outer clamping device 4 is connected to the connecting piece 2. The entire boat drive 8, including the steering device 9 and the mount 13, is elastically suspended relative to the boat's hull so that the reaction forces from the propeller thrust and the weight of the boat drive 8 are transferred directly into the hull. Accordingly, the connecting piece 2 is isolated relative to those forces, and is free from load. Owing to the elastic suspension the boat drive 8 undergoes oscillations, especially in the vertical direction (z direction), i.e. relative movement takes place between the inner clamping device 3 and the outer clamping device 4, which is allowed by the flexible sealing elements 5, 6.

The ring chamber 7, which is filled with a control liquid, communicates with a control container 11 which has a liquid level indicator 15 (shown only diagrammatically in FIG. 2). In the outer clamping device 4 are arranged a transverse and a longitudinal bore 12*a*, 12*b*, by means of which the ring chamber 7 can be connected, via a flexible connection line 16 (shown only diagrammatically in FIG. 2), to the control container 11. This system enables the function of the sealing elements 5, 6 to be checked. If the liquid level in the control container 11 changes, as a rule, there is a sealing malfunction. If the liquid level in the control container rises, the sealing element 6 on the seawater side is defective such that seawater flows into the ring chamber 7 and from there to the control container 11. If the liquid level in the control container 11 falls, the inner sealing element 5 is defective and the control liquid escapes from the ring chamber 7 to the inside of the boat. If the liquid level in the control container 11 is falling, it may also be the case that both sealing elements 5, 6 are leaking, such that seawater flows to the inside space of the boat. Thus, by virtue of the ring chamber 7 and its control liquid that communicates with the control container 11, it is possible to effectively and continuously check whether the seals are intact, or whether a defect in the form of leakage exists.

In the example embodiment illustrated, only one ring chamber 7 enclosed by two sealing element 5, 6 is shown. It is also possible and within the scope of the invention for more than one ring chamber, one behind another and divided by sealing elements, to be provided. This would give greater security against the development of leaks.

INDEXES

1 Sealing arrangement
2 Hull connecting piece
2*a* Steel plate
2*b* Steel plate
3 First (inner) clamping device
4 Second (outer) clamping device
5 Bellows seal
5*a* Ring bead
5*b* Ring bead
6 Bellows seal
6*a* Ring bead
6*b* Ring bead
7 Ring chamber
8 Boat drive
9 Steering device
9*a* Housing
10 Driveshaft
11 Control container
12*a* Transverse bore
12*b* Longitudinal bore
13 Mount
z Vertical axis

The invention claimed is:

1. A sealing arrangement for a boat drive (8) pivotably arranged in a hull of a boat, the boat drive (8) extends through a hull opening in a bottom of the boat such that the boat drive (8) forms an annular gap with one of the hull of the boat and a connecting piece (2) that is set into the hull of the boat;

the annular gap being bridged by at least flexible first and second sealing elements (5, 6), an inner clamping device clamping an inner periphery of the first and the second sealing elements and an outer clamping device clamping an outer periphery of the first and the second sealing elements;

the first and the second sealing elements (5, 6) enclosing at least one ring chamber (7) therebetween;

the connecting piece (2) being firmly connected to the hull of the boat with the hull of the boat being located between an inner plate and an outer plate of the connecting piece (2), and the first and the second sealing elements (5, 6) being arranged between an inside space of the hull of the boat and a seawater side of the hull of the boat and the outer clamping device is rigidly fixed to the connecting piece and the inner clamping device is rigidly fixed to the boat drive.

2. The sealing arrangement according to claim 1, wherein the at least one ring chamber (7) is filled with a control liquid and communicates with a control container (11).

3. The sealing arrangement according to claim 2, wherein the at least one ring chamber (7) is connected to the control container (11) by a flexible liquid line.

4. The sealing arrangement according to claim 2, wherein the control container (11) has a liquid level indicator which continuously checks a level of the control liquid in the control container, such that a rise in the level of the control liquid indicates that the second sealing element is defective and a fall in the level of the control liquid indicates that the first sealing element is detective.

5. The sealing arrangement according to claim 1, wherein the first and the second sealing elements are bellows seals (5, 6) which have inner and outer ring beads (5*a*, 5*b*, 6*a*, 6*b*), the inner ring beads of both of the first and the second sealing elements being clamped by the inner clamping device and the outer ring beads of both of the first and the second sealing elements being clamped by the outer clamping device.

6. The sealing arrangement according to claim 5, wherein the inner clamping device (3) is provided around a periphery of the boat drive (8) for holding the first and the second sealing elements (5, 6).

7. The sealing arrangement according to claim 5, wherein the outer clamping device (4) is arranged in an area of the hull opening for holding the first and the second sealing elements (5, 6).

8. The sealing arrangement according to claim 5, wherein the inner and the outer ring beads (5*a*, 5*b*, 6*a*, 6*b*) of the first and the second bellows seals (5, 6) are clamped such that the ring chamber is formed between the first and the second sealing elements, the ring chamber having a constant volume when both the first and the second sealing elements effectively function as seals.

9. The sealing arrangement according to claim 5, wherein the inner and the outer ring beads (5*a*, 5*b*, 6*a*, 6*b*) of the first and the second bellows seals (5, 6) are clamped by the inner and the outer clamping devices (3, 4) such that each of the first bellows seal, the second bellows seal, the inner clamping device and the outer clamping device define the ring chamber, the ring chamber having a constant volume when both the first and the second sealing elements effectively function as seals.

10. The sealing arrangement according to claim 9, wherein the first and the second sealing elements (5, 6) allow relative movements between the inner and the outer clamping devices (3, 4) in at least one of a vertical direction and a horizontal direction.

11. The sealing arrangement according to claim 5, wherein the inner clamping device (3) is provided around a periphery of the boat drive (8) for holding the first and the second sealing elements (5, 6); and the outer clamping device (4) is arranged in an area of the hull opening for holding the first and the second sealing elements (5, 6).

12. A sealing arrangement for a boat drive that supported by a connection piece which is fixed to a hull of a boat such that the boat drive extends through a bottom of the hull from an interior side of the hull to an exterior seawater side of the hull, the boat drive has a mount and a steering device which pivots about an axis with respect to the mount, wherein the sealing arrangement comprises:

a radially outer clamping device being connected fast to the connection piece and at least one bore which communicates, via a connection line, with control container;

a radially inner clamping device being fixed to the mount of the boat drive;

a first bellows seal having radially inner and outer beads, the inner bead of the first bellows seal being clamped by the inner clamping device and the outer bead of the first bellows seal being clamped by the outer clamping device;

a second bellows seal having radially inner and outer beads, the inner bead of the second bellows seal being clamped by the inner clamping device and the outer bead of the second bellows seal being clamped by the outer clamping device;

the first and the second bellows seals elastically supporting the boat drive in the hull such that the inner clamping device and the boat drive are movable with respect to the outer clamping device and the hull, the first bellows seal being arranged closer to the interior side of the hull than the second bellows seal and the second bellows seal being arranged closer to the exterior seawater side of the hull than the first bellows seal;

the inner beads of the first and the second bellows seals and the outer beads of the first and the second bellows seals are clamped such that each of the first bellows seal, the second bellows seal, the inner clamping device, and the outer clamping device define an annular chamber therebetween;

the annular chamber fluidly communicates with the control container via the bore in the outer clamping device and the connection line such that a liquid flows therebetween;

the control container comprises an indicator which checks a level of the liquid within the control container, the level of the liquid correlating to a sealing functionality of the first and the second bellows seals such that:

a rise of the level of the liquid in the control container correlates to a sealing malfunction of the second bellows seal; and a drop in the level of the liquid in the control container correlates to either a sealing malfunction of the first bellows seal or a sealing malfunction of the first and the second bellows seals.

* * * * *